United States Patent [19]

Schwing et al.

[11] Patent Number: 4,599,067

[45] **Date of Patent: * Jul. 8, 1986**

[54] APPARATUS FOR THE THERMAL REMOVAL OF LACQUER FROM METALLIC AND CERAMIC ARTICLES

[76] Inventors: Ewald Schwing, Wiesfurthstr. 99, 4133 Neukirchen-Vluyn; Peter Sommer, Johann-Strauss-Str. 13, 4174 Issum 2; Horst Uhrner, Schumannstr. 9, 4174 Issum, all of Fed. Rep. of Germany

[ * ] Notice: The portion of the term of this patent subsequent to Apr. 22, 2003 has been disclaimed.

[21] Appl. No.: 655,887

[22] Filed: Sep. 28, 1984

[30] Foreign Application Priority Data

Sep. 30, 1983 [DE] Fed. Rep. of Germany ..... 3335539

[51] Int. Cl.[4] ..... F27B 15/00

[52] U.S. Cl. ..... 432/58; 432/72; 432/197

[58] Field of Search ..... 432/15, 58, 72, 197

[56] References Cited

U.S. PATENT DOCUMENTS

| | | | |
|---|---|---|---|
| 353,016 | 11/1886 | Cadwell | 432/72 |
| 3,022,989 | 2/1962 | Pyzel | 432/15 |
| 3,399,874 | 9/1968 | Ritchie | 432/197 |

*Primary Examiner*—John J. Camby

*Attorney, Agent, or Firm*—Karl F. Ross; Herbert Dubno

[57] ABSTRACT

An apparatus for the thermal removal of lacquer and like coating materials from metal and ceramic objects comprises a fluidized-bed retort which is partly heated by a burner in a burner chamber formed in a unitary housing with the retort. Combustibles in the retort gases are recycled to an afterburner chamber for combustion to provide additional heating for the retort. The bottom of the retort is surrounded by an annular gap through which the afterburner gases pass and then to an outlet connected to the afterburner chamber by a valve.

5 Claims, 4 Drawing Figures

APPARATUS FOR THE THERMAL REMOVAL OF LACQUER FROM METALLIC AND CERAMIC ARTICLES

CROSS REFERENCE TO RELATED APPLICATION

This application is related to our concurrently filed copending application Ser. No. 655,869, based upon German application No. P 33 35 537.1 of Sept. 30, 1983.

FIELD OF THE INVENTION

Our present invention relates to an apparatus for the treatment of metallic and ceramic articles, so as to remove lacquers, paints and other coating materials from metallic and ceramic objects and, especially to an apparatus for bringing about a pyrolytic removal of such materials.

BACKGROUND OF THE INVENTION

It is known to provide pyrolytic coating-removal apparatus in which metallic and ceramic articles may be delacquered by subjecting them to a pyrolytic treatment in which the coating material partially evaporates, partially decomposes thermally, and partially burns so that the metal and ceramic objects can be freed after such coating.

Generally, the apparatus can include a burner which opens into a combustion chamber which generates the heat required for the delacquering process, an afterburner chamber and a fluidized bed retort which can be composed of refractory steel.

Via appropriate duct work or passages, incompletely combusted gases, i.e. gases containing pyrolytic decomposition products which remain combustible or contain combustible components, such as retort gases, are collected from the fluidized bed and burned in the afterburner chamber. The fluidized-bed retort can be a nozzle chamber with a floor formed by nozzles through which the carrier or fluidizing gas can be fed.

The carrier gas is usually air or oxygen-enriched air and is forced through the nozzle chamber or plenum communicating with nozzles by a blower.

The retort gas, i.e. the distillation residue-containing gas, is formed during the pyrolytic removal of the lacquer from the articles in the fluidized-bed retort.

A lacquer sludge which may arise from the coating apparatus can be introduced into the fluidized bed of the retort to add combustibles to the latter. Consequently, the distillation gases will contain complete combustion products, partial combustion products and other combustibles, and even incompletely burned or fully unburned components. For convenience in description, we will refer to an "exhaus gas" which is the afterburned gas which is discharged from the apparatus.

The afterburning of the distillation gases is carried out so that this step will remove all detrimental or noxious components which may be environmentally hazardous by burning so that the exhaust gas which is ultimately discharged will be free from noxious or toxic components.

The after-combustion also has the advantage that it allows recovery of the energy represented by combustible components in the distillation gases, energy which can be retrieved and utilized in the fluidized-bed retort for the delacquering process.

The objects which are to be treated can be suspended in the fluidized bed retort, for example in baskets, and the fluidized bed itself can be constituted of granules or particles of a material which is not significantly depletable, for example, quartz grains.

In general, one can provide adjacent the fluidized-bed retort a depositing grate upon which the hot products, after delacquering, can be placed.

In the conventional apparatus of this type, the distillation gas is fed to the afterburner chamber and is there burned with the detrimental components being decomposed and the energy of this combustion being utilized. The delacquering is carried out discontinuously in that the objects to be delacquered are introduced basket by basket into the fluidized-bed retort. The distillation gas which is produced also is therefore generated in surges or discontinuously or, in the case when a carrier gas is passed continuously through the system, the combustible components will appear in surges in this gas. The exhaust gases are therefore formed in an afterburner chamber which is subjected to high temperature variations or fluctuations ranging from 450° C. to 110° C., for example, and it is for this reason that the fluidized-bed retort cannot be heated directly by the combustion product of the afterburner chamber. The sensible heat of the combustion products of the afterburner, therefore, must be recovered in other ways.

One of the principal problems of the earlier systems has been the different units for combustion and afterburners which were used as the ducting systems thus required. High flow resistance, problems in flow control and problems with uniform temperature distribution, particularly when the retort had a rectangular cross section, were experienced.

OBJECTS OF THE INVENTION

It is the principal object of the present invention to provide an improved apparatus for the thermal delacquering of lacquered metals and ceramics whereby the disadvantages of the earlier devices are obviated.

Another object of this invention is to provide an apparatus for the purposes described which allows the fluidized-bed retort to be heated directly by the combustion gases of the afterburner chamber and at a substantially uniform temperature.

Still another object is to provide an apparatus of the class described which has improved gas-flow characteristics.

SUMMARY OF THE INVENTION

These objects and others which will become apparent hereinafter are attained, in accordance with the invention, by providing the combustion chamber, the after-combustion chamber, and fluidized-bed retort in a common housing in which at least the lower portion of the fluidized-bed retort is suspended in this housing and forms a circumferential gap therewith, below which the afterburner chamber is provided so that the afterburner chamber is closed from above by the nozzle chamber of the fluidized-bed retort. The gap communicates with a collecting passage located above the gap and preferably in the region of the level of the fluidized gap and this collecting chamber can be connected to an outlet for the exhaust gas which may, in turn, be connected to the afterburner chamber by a control valve in a bypass.

Advantageously, in accordance with the present invention, the fluidized-bed retort is disposed so that its bottom and side walls are directly contacted by the combustion product gases of the afterburner chamber which have a temperature of up to 1100° C. while at least a part of the fluidized-bed retort, which is contacted with the combustion gases from the after-combustion chamber, is lined with or formed of a heat storage material of a refractory ceramic, of a thickness, heat capacity and mass sufficient to level the temperature fluctuations so that the variations in the inside of the wall provided with this heat-storage material are less than about ±200° C. about a median temperature and most advantageously are less than about ±100° C. and preferably ±50° C. about this median temperature. As noted, the fluidized-bed retort can be provided with a nozzle chamber, and according to the invention, at least the walls of the nozzle chamber, including the bottom thereof and the side walls of the retort above the nozzle chamber to the extent contacted by the retort gases from combustion in the afterburner chamber, carry this refractory heat storage mass.

The heat-storage mass when utilized as described above, without significant loss of energy, results in a change in the temperature conditions within the retort so that the interior of the retort is subjected to a far more uniform temperature than has hitherto been the case even with batch-processing methods. The heat-storage mass acts as a buffer and levels out the temperature fluctuations.

The control valve can be a flap which is pivoted or a slider.

It should be apparent that the annular gap should correspond in geometry to that of the collecting passage and the outline of the fluidized-bed retort and can be circular when the retort has a cylindrical wall, the annular gap then communicating with a circular collecting passage. The annular gap can have a rectangular outline when the retort has a rectangular outline and can communicate with the collecting passage which also has a rectangular outline.

The bypass and control valve, of course, are utilized to control the temperature in the fluidized bed.

Between the upper part of the combustion chamber and the heat storage coating of the fluidized-bed retort, an apron can be provided.

The temperature of the fluidized bed should be about 450° C. while the temperature in the afterburner chamber can be in the range of 800° C. to 1100° C., with sharp fluctuations resulting from the approximately doubling of the volume in the flue gases which are produced by the afterburner. These temperature and volume changes are anticyclically related to the heat requirements for delacquering. In spite of this fact, the temperature in the fluidized bed can be held practically constant since not only does the storage capacity provide a leveling effect but the control valve can be utilized so that, when necessary, hot exhaust gas is directed around the fluidized-bed retort but when not necessary, the hot gas can be discharged.

Especially advantageous for flow requirements and the thermodynamics, control and regulation capabilities of the apparatus is an arrangement in which a downcomer is connected to the collecting passage and communicates with the outlet at the same level as the space of the afterburner chamber below the fluidized-bed retort. The bypass is then at the level of the afterburner chamber to serve as a hot circuit for the flow of the gas bypassing the annular gap and the downcomer.

If the control valve is opened, the short-circuit combustion gases of the afterburner pass directly out through the outlet and only the slight heating effect through the bottom of the fluidized-bed retort can occur. When the control valve is closed, however, the more substantial heating is effected since the combustion gases can pass through the narrow gap and intensively heat the lateral walls at the base of the retort.

The housing can be a steel-sheet housing provided with a lining of refractory material such as a refractory ceramic. This construction also allows the upper part of the combustion chamber to be formed with a downwardly extending apron which can be constituted of ceramic. The fluidized-bed retort can also be formed of a refractory or heat-resistant steel and can be externally lined with a heat-storage layer.

An advantage of this invention is that the flow through the unitary system of the invention suffers substantially less flow resistance than was the case when individual burner chambers and units were provided.

The refractory components can be formed by or lined with refractory tile and the bottom of the retort which is provided with the heat-storage refractory can likewise be provided with or formed by the refractory retort. When an aerodynamic configuration is given to the passages and surfaces, especially low flow resistance is obtained.

The system of the invention also has the advantage that the significant elements of the apparatus including the burner and the burner chamber, the afterburner chamber and the fluidized-bed retort, can be formed as a unitary structure with the housing so that the gas flow both for the combustion-product gases and for the gases which form the combustion products have an aerodynamically effective path with minimum flow resistance so that the uniformity of flow contributes to the possibility of careful control of the heating effect and the uniformity thereof.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
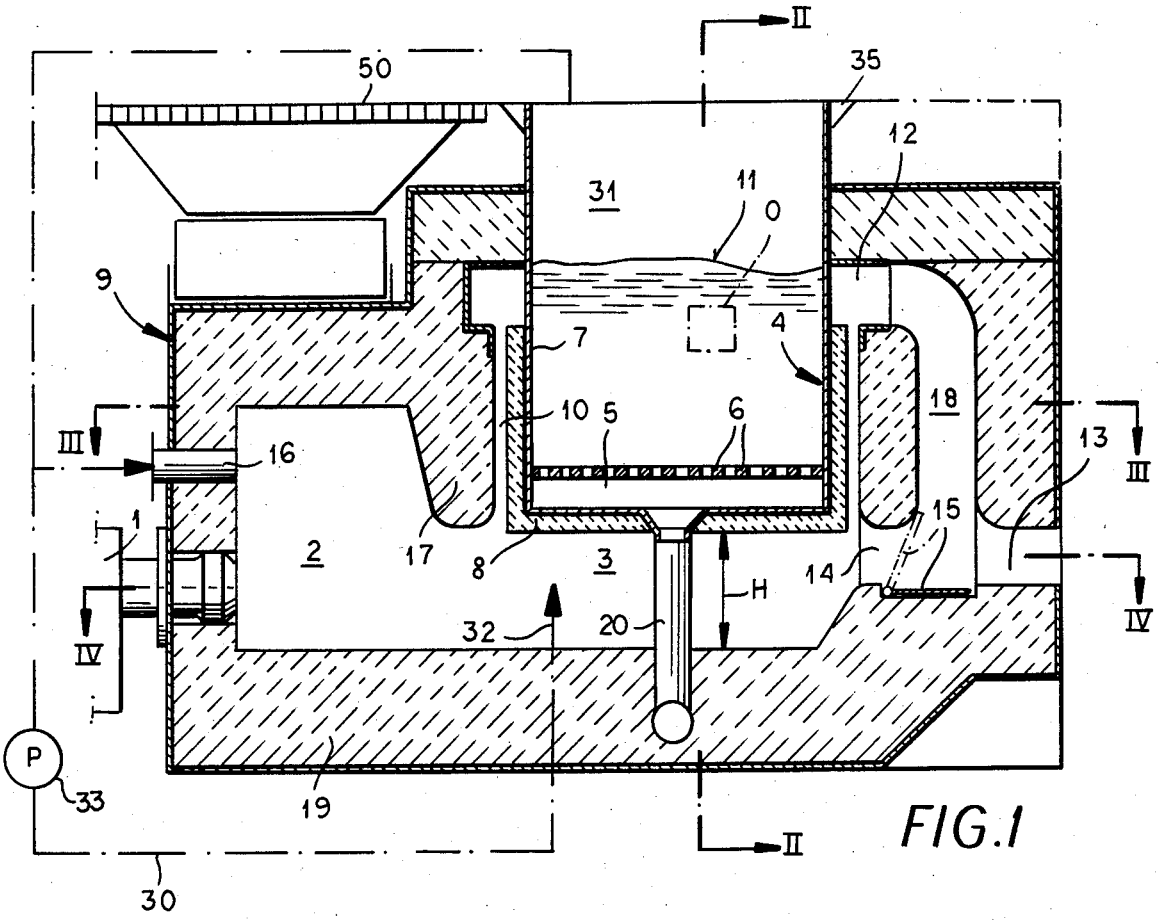
FIG. 1 is a vertical section diagrammatically illustrating the appartus of the present invention.

The apparatus shown in the drawing is used for the delacquering of metallic and ceramic objects and basically comprises a burner 1 which extends into a combustion chamber 2 in a housing which comprises a metal (steel sheet) wall 9 internally lined by a refractory ceramic at 19.

Connected to the combustion chamber 2 is an afterburner chamber 3 and the roof of the latter is formed by the bottom of a fluidized-bed retort 4 of heat-resistant steel.

The flow path 30, not shown in detail, represented by the dot-dash lines, collects the distillation mass from above the fluidized bed, i.e. the space 31 in the fluidized-bed retort and injects it at 32 into the afterburner chamber. A blower 33 can be provided for this purpose.

The fluidized-bed retort 4 has a lip 35 upon which a basket (not shown) can hang so that the basket can support articles from which lacquer is to be removed, i.e. metal and ceramic articles to be delacquered.

The fluidized-bed retort also is formed at its bottom with a nozzle chamber 5 or plenum which communicates with a fluidized bed proper through a nozzle plate 6. The fluidized bed is formed by quartz grains and has been represented at 11 and the objects are suspended within the fluidized bed. For the purpose of description, such an object has been shown in dot-dash lines at 0.

Figure 2:
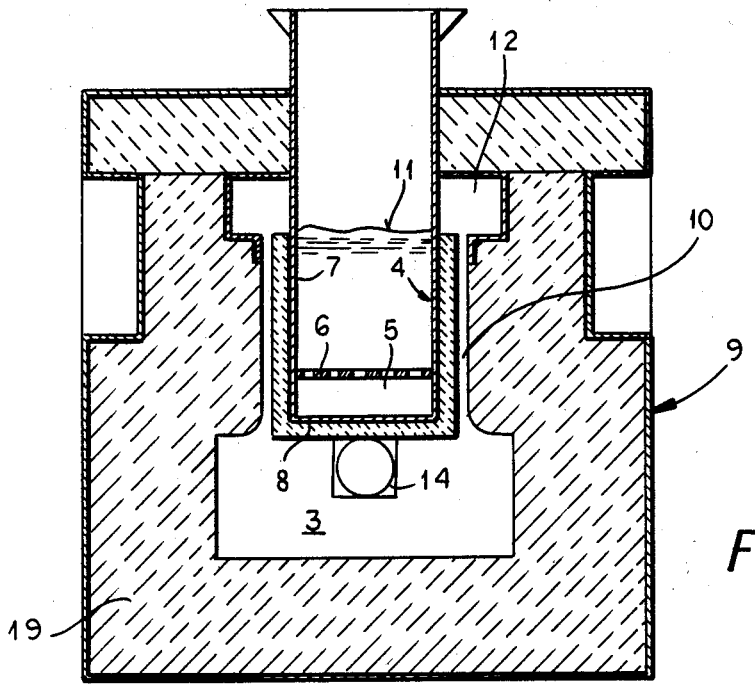
FIG. 2 is a section along the line II—II of FIG. 1.
Figure 3:
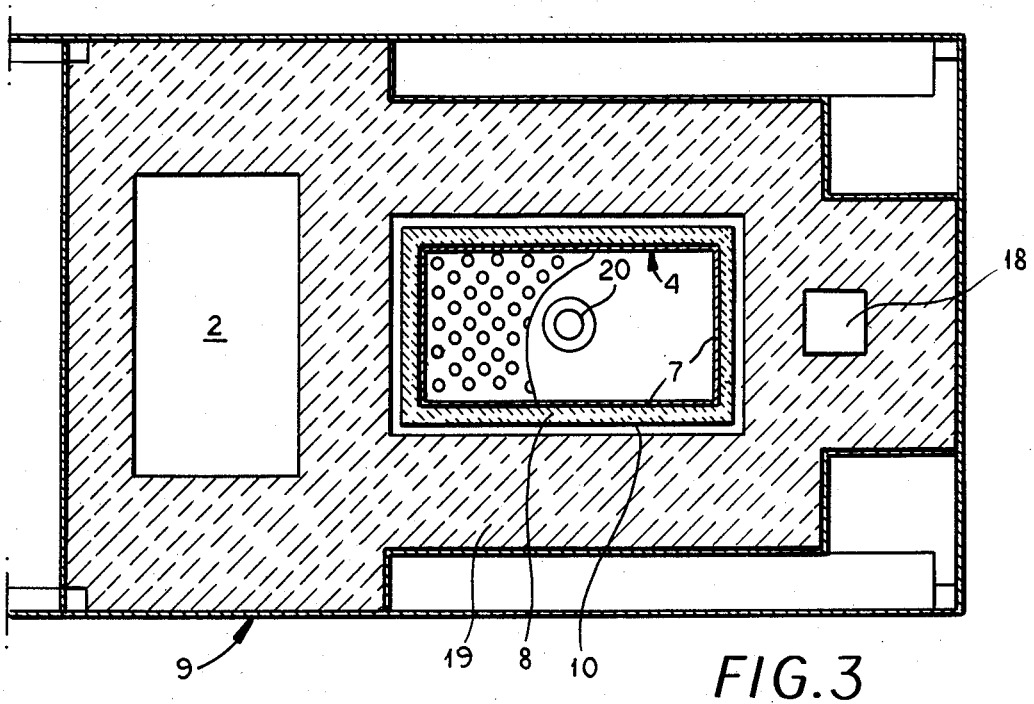
FIG. 3 is a section along the line III—III of FIG. 1.

As can be seen from FIGS. 1 through 3 as well, the bottom of the fluidized-bed retort and along its side wall 7, encompassing at the very least the height of the chamber 5, is a ceramic refractory heat-storage lining 8. This lining is juxtaposed with the housing which includes an apron 17 extending downwardly around the retort and defining an annular gap 10. The gases from the afterburner 3 can rise through this gap and can be at temperatures of up to 1100° C.

As is also apparent from FIGS. 1 through 4, the burner chamber 2, the afterburner chamber 3 and the fluidized-bed retort can all be built in to the common housing 9 and the retort is suspended in the region surrounded by the apron 17 so that the annular gap 10 is formed therewith.

In the embodiment illustrated, and as can be seen from FIG. 3, the fluidized-bed retort has a rectangular plane configuration or horizontal cross section so that the annular gap 10 is correspondingly rectangular.

Figure 4:
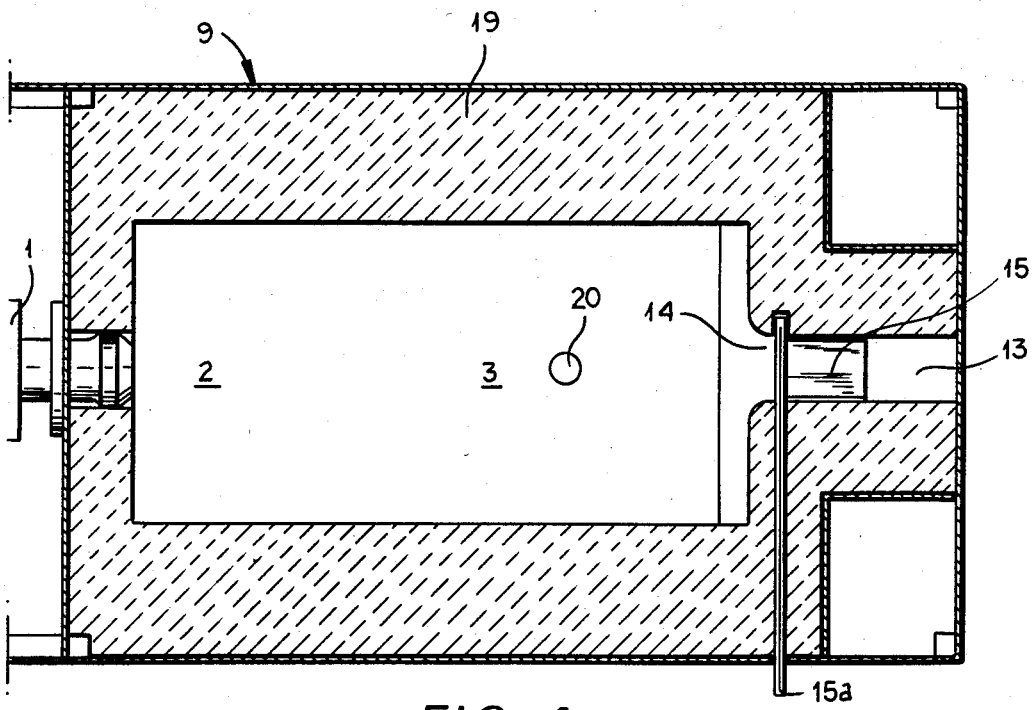
FIG. 4 is a section along the line IV—IV of FIG. 1.

At its upper end, the annular gap 10 opens at approximately the level 11 of the fluidized bed into a collecting passage 12 which is provided with the outlet 13 via the downcomer 18. The gas outlet 13 can communicate with the afterburner chamber via a bypass 14 which is provided with a control valve 15. The control valve 15 is shown in FIG. 1 to be a flap and has a control element 15*a* as shown in FIG. 4 by which it can be opened and closed for the purpose described previously.

As is also apparent from FIG. 1, the burner chamber 2 is approximately twice the height H of the afterburner 3 so that an additional inlet 16 can be provided for the distillation gases above the burner 1. Between the upper part of burner chamber 2 and the heat storage lining 8 of the retort 4, the apron 17 is provided. When the valve 15 is opened, as shown in FIG. 1, practically all of the exhaust gas is transferred directly to the outlet 13 and heating in the gap 10 does not occur whereas when this valve is closed, the gas is forced to flow through the gap and maximum heat transfer to the refractory heat storage member occurs.

The apparatus described is operated in the manner previously discussed, with the refractory heat storage mass 8 being sufficient to level heat flow surges which develop because the afterburning of the distillation gases only intermittently generates the highest temperature previously mentioned.

During the heating of the fluidized bed in the manner described, the bed is fluidized and additional heat is transferred to the object 0 by the oxygen-containing fluidizing gas stream which is fed to the plenum 5 by a pipe 20 within the fluidized-bed lacquer which is pyrolytically removed and partly decomposed and may be partially burned in this gas stream to produce the distillation gases. The grate on which the articles are placed after delacquering is shown at 50.

We claim:

1. An apparatus for delacquering metallic and ceramic objects, comprising:

a unitary housing formed with a burner chamber provided with at least one burner, and an afterburner chamber connected with said burner chamber;

a fluidized-bed retort in said housing having a bottom formed with a nozzle chamber communicating with the interior of said retort through nozzles for delivering a fluidizing gas to a fluidized bed in said retort into which said objects can be introduced for delacquering, the delacquering producing a retort gas containing combustibles;

means for feeding at least a portion of said retort gas from said retort to said afterburner chamber for combustion thereof to produce heat surges, said retort being heated from below by heat from said burner chamber and said afterburner chamber, said chambers and said retort being provided in a common housing, with the bottom of said retort being disposed above said afterburner chamber, and said housing defining with a wall of said retort adjacent said bottom, an annular gap traversed by combustion gases from said afterburner chamber; and an exhaust gas outlet connected with said gap and means in said housing forming a bypass between said afterburner chamber and said outlet, said bypass being provided with a valve for selectively controlling the passage of gas through said bypass and through said gap.

2. The apparatus as defined in claim 1, further comprising a body of refractory heat-storage ceramic material attached onto said retort in contact with gases from said afterburner chamber for leveling thermal surges to which said retort is subjected.

3. The apparatus defined in claim 1, further comprising a collecting passage chamber 12 surrounding said retort above said gap for collecting gas traversing said gap and conducting it to said outlet.

4. The apparatus defined in claim 3 wherein said collecting passage is connected to said outlet by a downcomer communicating with said outlet adjacent said valve.

5. The apparatus defined in claim 4 wherein said burner chamber is disposed above said afterburner chamber and is separated by a downwardly extending lip-shaped apron 35 from said retort, said apron defining said gap with said retort.

* * * * *